US007372368B2

(12) United States Patent
Chapman et al.

(10) Patent No.: US 7,372,368 B2
(45) Date of Patent: May 13, 2008

(54) REMOTE TIMER, THERMOMETER AND PAGING SYSTEM

(75) Inventors: Peter A. Chapman, Avon By The Sea, NJ (US); Michael A. Cousins, New York, NY (US)

(73) Assignee: Maverick Industries, Inc., Edison, NJ (US)

( * ) Notice: Subject to any disclaimer, the term of this patent is extended or adjusted under 35 U.S.C. 154(b) by 135 days.

(21) Appl. No.: 11/384,757

(22) Filed: Mar. 20, 2006

(65) Prior Publication Data

US 2007/0222580 A1 Sep. 27, 2007

(51) Int. Cl.
*G08B 17/00* (2006.01)

(52) U.S. Cl. ..... 340/584; 340/309.16; 340/539.1; 340/540; 340/588

(58) Field of Classification Search ..... 340/584, 340/309.16, 539.1, 539.23, 539.32, 540, 340/686.1, 568.1, 581, 588
See application file for complete search history.

(56) References Cited

U.S. PATENT DOCUMENTS 4,089,322 A 5/1978 Guibert
4,966,125 A 10/1990 Stephen et al.
5,634,719 A 6/1997 La Neve
5,790,021 A * 8/1998 Mickel et al. ..... 340/539.32
5,983,783 A 11/1999 Archard et al.
6,000,845 A 12/1999 Tymkewicz et al.
6,568,848 B1 5/2003 Chapman et al.
6,712,505 B2 3/2004 Chapman et al.
6,811,308 B2 11/2004 Chapman et al.
6,836,212 B2 * 12/2004 Sawinski ..... 340/539.23
6,879,254 B1 * 4/2005 Graham ..... 340/539.32

* cited by examiner

*Primary Examiner*—Davetta W. Goins
(74) *Attorney, Agent, or Firm*—Lerner, David, Littenberg, Krumholz & Mentlik, LLP

(57) ABSTRACT

A remote timer, thermometer and paging system includes a first unit having a radio frequency transmitter, a housing having a recess formed therein and a timer for selecting a time period. The system includes a temperature sensor in communication with the first unit for measuring temperature. The system also includes a second unit having a radio frequency receiver adapted to communicate with the radio frequency transmitter of the first unit. The first unit is adapted to wirelessly transmit an alert signal to the second unit when the temperature measured by the temperature sensor matches a pre-selected temperature or when the selected time period has expired. The second unit is insertible into the recess for storage inside the first unit and is removable from the first unit for moving the second unit to a remote location away from the first unit. The first unit includes a controller that deactivates the radio frequency transmitter when the second unit is at least partially inserted into the recess and activates the radio frequency transmitter when the second unit is removed from the recess so as to provide for wireless communication between the first and second units.

19 Claims, 3 Drawing Sheets

ALERT TEMPERATURE AND TIMER DISPLAY

ALERT TEMPERATURE AND MEAT TEMPERATURE DISPLAY

ALERT TEMPERATURE AND TIMER DISPLAY

ALERT TEMPERATURE AND MEAT TEMPERATURE DISPLAY

REMOTE TIMER, THERMOMETER AND PAGING SYSTEM

BACKGROUND OF THE INVENTION

The present invention generally relates to food preparation and more specifically relates to timers and thermometers that are used to ensure that food, such as meat, is adequately cooked.

The accurate and reliable measurement of temperatures is particularly important in the food preparation industry. Cooking to exact temperature ranges is critical in gourmet cooking and to avoid undercooking food items. As a result, a number of devices have been developed to accurately measure the temperature of food items being cooked.

U.S. Pat. No. 6,000,845 to Tymkewicz et al. discloses a temperature sensing and indicating device including a housing and an arm that is retractable and extendable into and out of the housing so that the length of the arm can be varied in a predetermined manner. A probe having a temperature sensor therein is enclosed by the arm so that varying the external length of the arm exposes varying lengths of the probe, whereby the exposed length of the probe is inserted into a medium so that the temperature sensor senses the temperature of the medium and converts the temperature sensed into a signal. Using a microprocessor, the signal is conditioned and converted for controlling a visual display that provides a visual indication of the temperature sensed. The visual indication includes a digital numeric display and an analog display.

U.S. Pat. No. 4,089,322 discloses a temperature monitoring device that is typically used with household cooking ranges, ovens, microwave ovens and the like. The device includes a probe having an internal cavity that receives a temperature expansive material such as wax. The cavity is in communication with a displaceable member such as a piston that is responsive to the pressure of the temperature expansive material and is mechanically linked to a latch mechanism that inhibits the operation of a sonic or ultra-sonic signal generator. The assembly is interconnected by adjustment means permitting a variable space between the latch mechanism and the displaceable member, whereby the trigger temperature mechanism can be adjusted.

U.S. Pat. No. 5,983,783 to Archer discloses an electronic chef's fork which displays indicia such as food type and degree of doneness for a selected food type and temperature, and which includes control areas by which a user selects a meat type. The electronic chef's fork includes operational circuitry that enables a user to select among an array of food type options and to designate a degree of doneness for the selected food types. A prompt message is provided to indicate the degree of doneness attained for the selected food type when the device is inserted into food.

U.S. Pat. No. 4,966,125 discloses a barbecue kettle including a bowl and a cover with the bowl having a food support grid adjacent and an upper rim and a charcoal grid below the food grid along with a cover holder adjacent the rim of the bowl. The cover has a removable thermometer that can sense the internal temperature of the kettle and can also be used as a food thermometer.

U.S. Pat. No. 5,634,719 discloses a food-handling device which a retractable boom mounted temperature probe. The tool has a probe mounted on a manually retractable boom, the probe being extendable over various sites of the food being checked. The boom is pivotally attached to the elongated arm of a spatula and, by a scissor-like action, is raised out of and lowered into the food. The tool is provided with a temperature indicator in the form of a digital readout.

Commonly assigned U.S. Pat. No. 6,568,848, the disclosure of which is hereby incorporated by reference herein, teaches a wireless remote cooking thermometer system includes a first unit positionable at a first location adjacent food being cooked, the first unit including a radio frequency transmitter adapted to transmit temperature readings for the food being cooked, and a temperature sensor connectable to the first unit for providing temperature readings to the first unit, the temperature sensor including a substantially rigid temperature probe insertable into the food being cooked and a substantially flexible communication line extending between the temperature probe and the first unit so that the substantially rigid temperature probe is positionable at a plurality of orientations relative to the first unit. The system also includes a second unit including a radio frequency receiver adapted to receive the temperature readings transmitted by the radio frequency transmitter and a visual display for displaying the received temperature readings, wherein the second unit is movable to a second location remote from the first location while maintaining radio contact with the first unit so as to allow for continuous temperature monitoring of the food being cooked.

Commonly assigned U.S. Pat. No. 6,712,505, the disclosure of which is hereby incorporated by reference herein, teaches a method of remotely monitoring the cooking of meat includes providing a first hand-held unit having a first liquid crystal display and a radio frequency transmitter, providing a temperature sensor in communication with the first unit, the temperature sensor including a substantially rigid temperature probe and a substantially flexible communication line extending, positioning the first unit adjacent a heating compartment, providing a second hand-held unit having a second liquid crystal display and a radio frequency receiver for receiving the temperature readings transmitted by the radio frequency transmitter, selecting a meat for temperature monitoring, selecting a taste preference associated with the selected meat, placing the meat in thermal communication with the heating compartment, inserting the probe into the meat for obtaining temperature readings for the meat, communicating the temperature readings from the probe to the first unit, moving the second unit to a second location spaced from the first unit and transmitting the temperature readings by radio frequency from the first unit to the second unit.

Commonly assigned U.S. Pat. No. 6,811,308, the disclosure of which is hereby incorporated by reference herein, teaches a wireless remote cooking thermometer system includes a first unit positionable at a first location adjacent food being cooked, the first unit including a radio frequency transmitter adapted to transmit temperature readings for the food being cooked, and a temperature sensor connectable to the first unit for providing temperature readings to the first unit, the temperature sensor including a substantially rigid temperature probe insertable into the food being cooked and a substantially flexible communication line extending between the temperature probe and the first unit so that the substantially rigid temperature probe is positionable at a plurality of orientations relative to the first unit. The system also includes a second unit including a radio frequency receiver adapted to receive the temperature readings transmitted by the radio frequency transmitter and a visual display for displaying the received temperature readings, wherein the second unit is movable to a second location remote from the first location while maintaining radio contact with the first unit so as to allow for continuous temperature monitoring of the food being cooked.

In spite of the above advances, there remains a need for improved paging systems. There also remains a need for improved timer and/or temperature monitoring systems. There is also a need for systems that include remote wireless units that enable an operator to move away from a base unit located next to a grill, stove, microwave, heating and/or cooking unit.

SUMMARY OF THE INVENTION

In certain preferred embodiments of the present invention, a remote paging system includes a first unit having a radio frequency transmitter and including a housing having a recess formed therein, and a second unit, such as a pager unit, having a radio frequency receiver adapted to communicate with the radio frequency transmitter of the first unit, whereby the second unit is insertible into the recess of the housing for storing the second unit with or inside the first unit.

In certain preferred embodiments, the second unit is at least partially insertible into the recess of the housing for deactivating the radio frequency transmitter and is removable from the recess of the housing for activating the radio frequency transmitter so as to provide for wireless communication between the first and second units. The first unit may includes a switch located in the recess of the housing that is movable between a first position for deactivating the radio frequency transmitter and a second position for activating the radio frequency transmitter. The second unit preferably engages the switch when at least partially inserted into the recess of the housing for moving the switch into the first position for deactivating the radio frequency transmitter, the radio frequency receiver, or both the transmitter and the receiver. The switch may be a pressure switch.

The first unit preferably comprises a temperature monitoring element for selecting a temperature and a controller in communication with the temperature monitoring element for generating an alert signal when a monitored temperature matches the selected temperature. The controller may be in communication with the radio frequency transmitter for wirelessly transmitting the alert signal from the radio frequency transmitter to the radio frequency receiver of the second unit. The first unit may also include a timer for selecting a time period and a controller in communication with the timer for generating an alert signal when the selected time period has expired. The controller is in communication with the radio frequency transmitter for wirelessly transmitting the alert signal from the radio frequency transmitter to the radio frequency receiver of the second unit. In certain preferred embodiments, the first unit includes both a temperature monitoring element and a timer. In other preferred embodiments, the first unit may include either a temperature monitoring element or a timer.

The first unit may include a visual display, such as a liquid crystal display (LCD). The visual display may selectively display temperature information and/or time information.

In other preferred embodiments of the present invention, a remote paging system includes a first unit having a radio frequency transmitter, a housing having a recess formed therein, and a temperature sensor for measuring temperature, the temperature sensor being in communication with the first unit. The system desirably includes a second unit having a radio frequency receiver adapted to communicate with the radio frequency transmitter of the first unit, the second unit being insertible into the recess of the housing for storing the second unit with the first unit. The first unit is desirably adapted to wirelessly transmit an alert signal to the second unit when the temperature measured by the temperature sensor matches a pre-selected temperature. The first unit may also include a timer for selecting a time period and a controller in communication with the timer for generating an alert signal when the selected time period has expired. The controller is desirably in communication with the radio frequency transmitter for wirelessly transmitting the alert signal from the radio frequency transmitter to the radio frequency receiver of the second unit. The second unit is at least partially insertible into the recess of the housing for deactivating the radio frequency transmitter and is removable from the recess of the housing for activating the radio frequency transmitter so as to provide for wireless communication between the first and second units.

In certain preferred embodiments, the recess of the first unit is bounded by an outer surface of the housing. In these embodiments, after the second unit is fully inserted into the recess of the housing, the second unit has an exposed surface that is substantially flush with the outer surface of the housing that surrounds the recess. In some preferred embodiments, the housing has a curved surface that surrounds the recess and after the second unit is fully inserted into the recess, the second unit has an exposed curved surface that matches the curved surface of the housing that surrounds the recess. In still other preferred embodiments, the housing has a spherical surface that surrounds the recess and after the second unit is fully inserted into the recess, the second unit has an exposed spherical surface that matches the spherical surface of the housing that surrounds the recess.

In further preferred embodiments of the present invention, a remote timer, thermometer and paging system includes a first unit having a radio frequency transmitter and including a housing having a recess formed therein, the first unit including a timer for selecting a time period. The system desirably includes a temperature sensor for measuring temperature, the temperature sensor being in communication with the first unit. The system preferably includes a second unit having a radio frequency receiver adapted to communicate with the radio frequency transmitter of the first unit. The first unit is adapted to wirelessly transmit an alert signal to the second unit when the temperature measured the temperature sensor matches a pre-selected temperature or when the selected time period has expired. The second unit is preferably insertible into the recess for storage inside the first unit and is removable from the first unit for moving the second unit away from the first unit.

In certain preferred embodiments, the first unit includes a controller that deactivates the radio frequency transmitter when the second unit is at least partially inserted into the recess and activates the radio frequency transmitter when the second unit is removed from the recess so as to provide for wireless communication between the first and second units. In other preferred embodiments, the radio frequency transmitter and/or the radio frequency receiver may be activated by switches on either the first unit or the second unit.

These and other preferred embodiments of the present invention will be described in more detail below.

DETAILED DESCRIPTION

Figure 1:
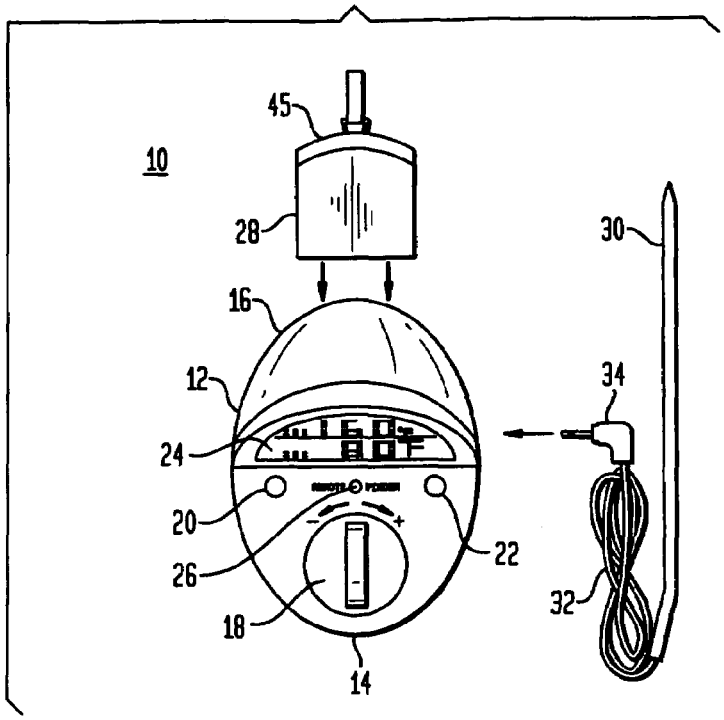
FIG. 1 shows a remote timer, thermometer and paging system including a housing, a temperature sensor and a paging unit, in accordance with certain preferred embodiments of the present invention.

FIG. 1 shows a paging system, in accordance with certain preferred embodiments of the present invention. The system 10 includes a housing 12 having a front end 14 and a rear 16. The housing includes a rotatable dial 18, a first control 20 for selecting whether a temperature is to be displayed in Fahrenheit or Celsius and a second control 22 for selecting whether or not a time display is to be shown on visual display 24. The housing also includes a remote finder button 26 that may be depressed so as to locate remote pager 28. The remote timer, thermometer and paging system also includes a temperature probe 30 having a flexible connecting wire 32 and a plug 34 insertible into an electrical outlet accessible at an outer surface of the housing 12.

Figure 2:
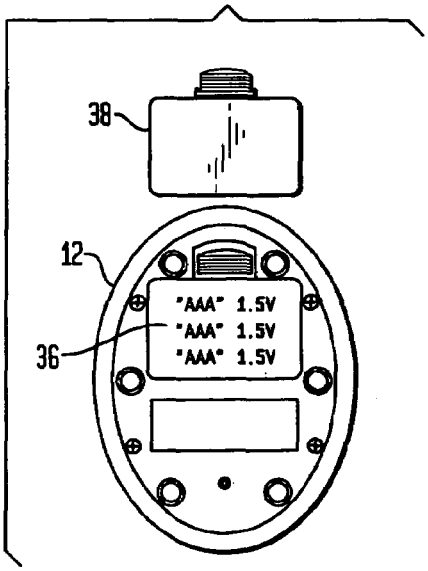
FIG. 2 shows a bottom plan view of the housing shown in FIG. 1.

FIG. 2 shows a bottom plan view of housing 12 including battery compartment 36 for holding one or more batteries and a battery cover 38 that selectively covers the battery compartment 36.

Figure 3:
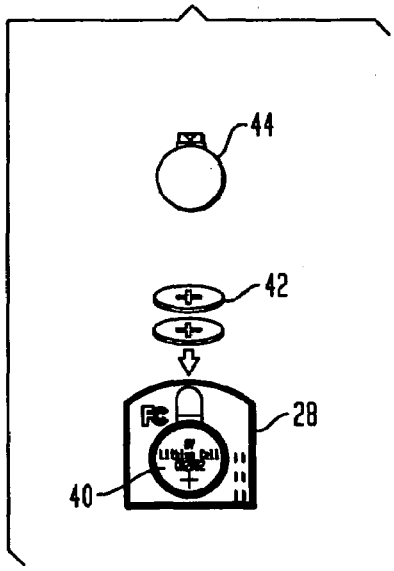
FIG. 3 shows a bottom plan view of the paging unit shown in FIG. 1.

Referring to FIG. 3, the remote paging unit 28 includes a battery compartment 40 adapted to receive one or more batteries 42 and a battery cover 44 that selectively covers the battery compartment. As shown in FIG. 1, the paging unit 28 may have a pull cord or similar element attached thereto for removing the paging unit from the recess of the first unit.

Figure 4A:
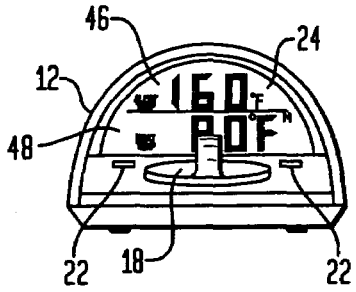
FIG. 4A shows a front elevational view of the housing shown in FIG. 1.

FIG. 4A shows a front elevational view of the housing 12. The housing includes visual display 24 that is preferably divided into an upper section 46 and a lower section 48. In certain preferred embodiments, the upper section 46 displays an alert temperature, which is a final desired cooking temperature selected by a user. The lower section 48 of the visual display 24 may display the actual recorded temperature or may show a timer display as will be described in more detail below.

The housing 12 includes a rotatable knob 18 that may be rotated to the left for reducing a final desire cooking temperature and/or a length of time selected for cooking. The rotatable knob 18 may be rotated to the right for increasing the final desire cooking temperature and/or the length of time desired for cooking. Housing 12 preferably includes a first control 20 for toggling the visual display 24 between displaying temperature in Fahrenheit or in Celsius. Housing 12 also includes second control 22 which may be engaged for toggling the lower section 48 of the visual display 24 between displaying the measured temperature or displaying a time for cooking. In one preferred embodiment, once the plug 34 of the temperature probe is plugged into the housing, the lower section 48 of the visual display 24 will automatically show the temperature recorded by the temperature probe. If an operator desires to show how much time is left for cooking, after the temperature probe is plugged into the housing, an operator may depress the second control 22 for changing to time remaining.

Figure 4B:
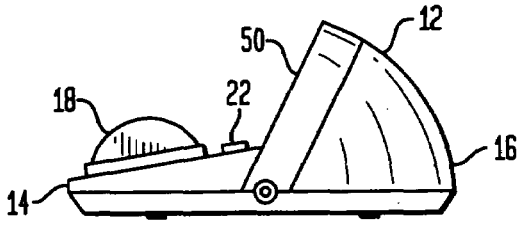
FIG. 4B shows a side elevational view of the housing shown in FIG. 1.

FIG. 4B shows a side elevational view of housing 12 including front end 14 and rear 16. The housing includes rotatable knobs 18 and sloping face 50 which includes the visual display 24 (FIG. 4A). Housing 12 also includes second control 22 which may be engaged for toggling between a display of an actual measure temperature and the time remaining for cooking.

Figure 4C:
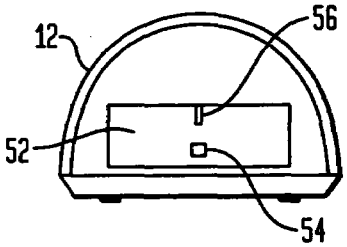
FIG. 4C shows a rear elevational view of the housing shown in FIG. 1.

FIG. 4C shows a rear elevational view of housing 12. The rear of housing 12 includes a recess 52 formed therein that is sized and shaped to receive the paging unit 28 shown in FIG. 1. The housing includes a switch 54 providing in the recess 52. When the paging unit is inserted into the recess 52, a leading edge of the paging unit preferably engages the switch 54 for deactivating radio transmissions between the housing 12 and the paging unit 28. When the paging unit 28 is removed from the housing 12, the switch 54 preferably moves into an extended position for activating a radio transmitter that sends signals from the housing 12 to the remote paging unit 28. The recess 52 also preferably includes a projection or guide 56 that guides the paging unit into proper seating or alignment within the recess. The guide 56 preferably guides the paging unit into place and further ensures that the switch 54 is properly engaged when the paging unit is inserted into the recess.

Referring to FIGS. 1 and 4B, the rear 16 of the housing 12 preferably has a curved or spherical surface and a rear 45 of paging unit 28 also preferably has a curved or spherical surface that matches the curved/spherical surface of the rear 16 of the housing 12. As a result, when the paging unit 28 has been inserted into the recess of the housing, the exposed surface of the paging unit has a curved or spherical surface that matches the curved or spherical surface of the housing that surrounds the recess. Once inserted into the recess, the exposed surface of the paging unit 28 is preferably flush with the outer surface of the housing that surrounds the recess 52 (FIG. 4C).

In order to remove the paging unit from the housing, the paging unit may have a pull cord attached thereto. In other preferred embodiments, the exposed surface of the paging unit may be pressed into the recess, whereby the paging unit pops slightly out of the recess for being grasped and removed from the recess. The first unit may include one or more springs provided in the recess for selectively ejecting the paging unit from the housing. The one or more springs preferably engage the paging unit to force the paging unit at least partially out of the recess.

Figure 5A:
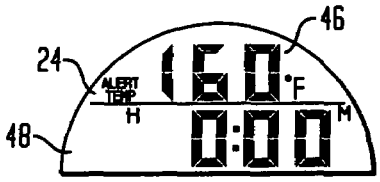
FIG. 5A shows a visual display on the housing shown in FIG. 1, in accordance with one preferred embodiment of the present invention.

FIG. 5A shows the visual display 24 when the remote paging unit is inserted into the recess in the rear of the housing and when the temperature probe is not plugged into the housing. In this state, the upper section 46 of the visual display shows the alert temperature or the final desired cooking temperature that has been selected by an operator. The alert temperature may be shown in Fahrenheit or Celsius. In order to toggle between Fahrenheit and Celsius, an operator may engage first control 20 (FIG. 4A). With the temperature probe decoupled from the housing, the lower section 48 of the visual display 24 shows the time remaining for cooking. In the particular preferred embodiment shown in FIG. 5A, the time display includes hours and minutes remaining in a cooking operation. In other preferred embodiments, however, the time display may show time in minutes and seconds; hours, minutes and seconds; or days, hours, minutes and seconds. The present invention contemplates that any length of time or time unit may be displayed on the visual display 24 and still fall within the scope of the present invention.

The exact length of time selected and displayed on the lower section 48 may be controlled by rotating knob 18 (FIG. 4A). Referring to FIG. 4A, the knob 18 may be rotated to the left for reducing the time shown on the lower section 48. The rotatable know 18 may be rotated to the right for increasing the time shown in lower section 48. In other preferred embodiments, the rotatable knob 18 may be turned to the left for increasing time and to the right for decreasing time. In still other preferred embodiments, the rotatable knob 18 may be replaced by any mechanism well-known to those skilled in the art for selecting a time period for cooking.

Figure 5B:
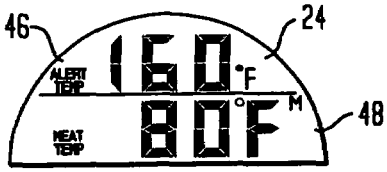
FIG. 5B shows a visual display on the housing shown in FIG. 1, in accordance with another preferred embodiment of the present invention.

FIG. 5B shows visual display 24 after the temperature probe has been coupled with the housing. Once the temperature probe is coupled with the housing, the lower section 48 of the visual display 24 shows the temperature measured by the temperature probe, while the upper section 46 of the visual display 24 continues to show the final desired cooking temperature. In certain preferred embodiments, even after the temperature probe has been coupled with the housing, the lower section 48 may still display the time remaining in a cooking operation. In certain preferred embodiments, referring to FIG. 1, the second control 22 may be engaged for changing the lower section 48 so that it no longer shows the actual temperature measured by the temperature probe and now shows the time remaining in the cooking operation. An operator may engage the second control 22 once again to change back from the time remaining in the cooking operation to the actual temperature measured by the temperature probe. Thus, an operator can manipulate the lower section 48 of the visual display 24 so that is toggles back and forth between the time remaining in the cooking operation and the actual measured temperature, even after the temperature probe has been coupled with the housing.

Figure 6A:
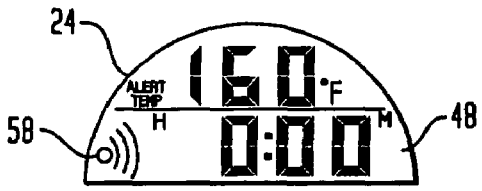
FIG. 6A shows a visual display on the housing shown in FIG. 1, in accordance with another preferred embodiment of the present invention.
Figure 6B:
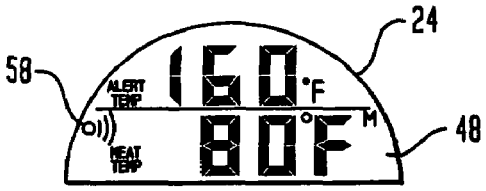
FIG. 6B shows a visual display on the housing shown in FIG. 1, in accordance with still another preferred embodiment of the present invention.

The visual display also preferably indicates whether the pager has been removed from the housing. FIGS. 6A and 6B show the visual display when the pager has been removed from the housing. In FIG. 6A, the lower section 48 of the visual display 24 includes a radio wave transmission symbol 58 that is activated when the paging unit is removed from the recess in the rear of the housing. FIG. 6A shows the visual display when the temperature probe is not coupled with the housing and/or when the second control has been engaged for changing the lower section 48 from showing a actual measured temperature to the time remaining in a cooking cycle. FIG. 6B shows visual display 24 after the pager has been removed from the recess and the temperature probe is coupled with the housing. The lower section 48 of the visual display shows the radio transmitting symbol 58 which indicates that radio signals are being sent to the paging unit.

Figure 7:
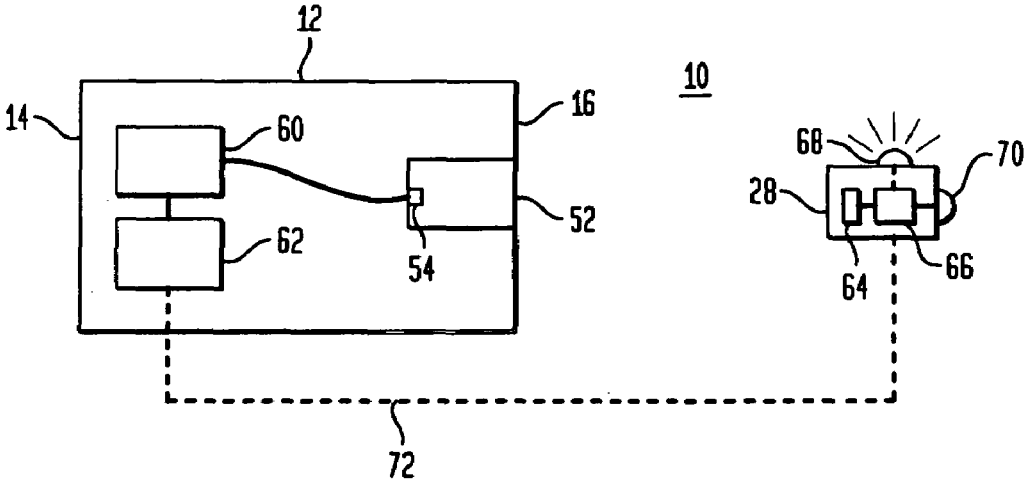
FIG. 7 shows a schematic view of a remote timer, thermometer and paging system, in accordance with still further preferred embodiments of the present invention.

FIG. 7 shows a schematic view of the remote timer, thermometer and paging system of the present invention. The system includes housing 12 having front end 14 and rear 16 with recess 52 formed in the rear. The recess 52 includes a switch 54 that is depressed when the paging unit is inserted into the recess and is extended when the paging unit is removed from the recess. The housing includes a controller 60, such as a controller including a microprocessor, and a radio transmitter 62 that is coupled with the controller 60. The controller 60 is preferably in communication with the visual display and all of the knobs and bottoms provided on the housing. The controller is preferably in two-way communication with the radio frequency transmitter 62 and the switch 54.

The system 10 also preferably includes the remote paging unit 28 including a radio frequency receiver 64 and a controller 66. The paging unit 28 also preferably includes an audible signal generator 68 for generating a beep, alarm or sound. The paging unit 28 may also include an LED for other type of light generating element 70.

In operation, a user selects a final desired cooking temperature and/or a time period for cooking. The user may decrease or increase the final desire cooking temperature by manipulating one or more of the knobs and/or controls provided of the first unit. The user may also select a length of time for cooking by manipulating the same knobs and/or controls. The user may monitor the cooking temperature or the time remaining for cooking by staying next to the housing, without using the remote paging unit. With the paging unit in the recess of the housing, the radio frequency transmitter 62 is preferably deactivated. At the same time, the paging unit is also preferably deactivated, thereby saving battery power. In this mode, when the final desired cooking temperature has been reached or the time for cooking has expired, a visual or audible sound will be generated by the first unit.

When an operator desires to move away from the housing 12 of the first unit, the remote paging unit 28 may be removed from the rear 16 of the housing. Once the remote paging unit 28 is removed, the radio transmitter 62 in the housing is activated and the radio receiver 64 in the paging unit 28 is activated. Radio frequency signals 72 are periodically transmitted from the radio frequency transmitter 62 to the radio frequency receiver 64. Once a desired cooking temperature has been reached and/or the time for cooking has expired, an alert signal will be sent from the first unit to the paging unit. The paging unit 28 will preferably receive the alert signal and generate a visual or audible indicator. The wireless transmission from the housing 12 to the remote paging unit 28 will be terminated once the paging unit is reinserted back into the rear 16 of the housing 12. Upon reinsertion, an edge of the remote paging unit 28 preferably engages the depressible switch 54 for deactivating wireless transmission.

In certain preferred embodiments, the controller 66 in the wireless paging unit 28 includes at least one microprocessor. In other preferred embodiments, the radio frequency receiver 64 and the remote paging unit 28 may also include a radio frequency transmitter for sending signals back to the housing 12. In these particular embodiments, the radio frequency transmitter 62 and the housing 12 also includes a radio frequency receiver for receiving the signals from the remote paging unit. The remote paging unit may also include one or more control buttons or knobs on an exterior surface thereof for controlling operation of the remote paging unit 28 or the first unit. In other preferred embodiments, one or more of the elements found on the first unit may be transferred to the remote paging unit 28. In addition, one or more elements found in the remote paging unit may be transferred to the first unit. Thus, any of the elements found in the system may be found on either the first unit, the remote paging unit 28, or on both the first unit and the remote paging unit 28.

The invention claimed is:

1. A remote paging system comprising:

a first unit having a radio frequency transmitter and including a housing having a recess formed therein; and a second unit having a radio frequency receiver adapted to communicate with said radio frequency transmitter of said first unit, wherein said second unit is insertible into the recess of said housing for storing said second unit with said first unit;

wherein said first unit further comprises a temperature monitoring element for selecting a temperature and a controller in communication with said temperature monitoring element for generating an alert signal when a monitored temperature matches the selected temperature, said controller wirelessly communicating with said radio frequency transmitter to transmit the alert signal from said radio frequency transmitter to said radio frequency receiver of said second unit.

2. The system as claimed in claim 1, wherein said second unit is storable inside said first unit.

3. The system as claimed in claim 1, wherein said second unit is a pager.

4. The system as claimed in claim 1, wherein said second unit is at least partially insertible into the recess of said housing for deactivating said radio frequency transmitter and is removable from the recess of said housing for activating said radio frequency transmitter so as to provide for wireless communication between said first and second units.

5. The system as claimed in claim 4, wherein said first unit includes a switch located in the recess of said housing that is movable between a first position for deactivating said radio frequency transmitter and a second position for activating said radio frequency transmitter.

6. The system as claimed in claim 5, wherein said second unit engages said switch when at least partially inserted into the recess of said housing for moving said switch into the first position for deactivating said radio frequency transmitter.

7. The system as claimed in claim 5, wherein said switch is a pressure switch.

8. The system as claimed in claim 1, said first unit further comprising a timer for selecting a time period and a controller in communication with said timer for generating an alert signal when the selected time period has expired, wherein said controller is in communication with said radio frequency transmitter for wirelessly transmitting the alert signal from said radio frequency transmitter to said radio frequency receiver of said second unit.

9. The system as claimed in claim 1, said first unit further comprising a visual display.

10. The system as claimed in claim 9, wherein said visual display is a liquid crystal display.

11. The system as claimed in claim 9, wherein said visual display selectively displays temperature information.

12. The system as claimed in claim 9, wherein said visual display selectively displays time information.

13. A remote paging system comprising:

a first unit having a radio frequency transmitter and including a housing having a recess formed therein;

a temperature sensor for measuring temperature, said temperature sensor being in communication with said first unit;

a second unit having a radio frequency receiver adapted to communicate with said radio frequency transmitter of said first unit, wherein said second unit is insertible into the recess of said housing for storing said second unit with said first unit, wherein said first unit is adapted to wirelessly transmit an alert signal to said second unit when the temperature measured by said temperature sensor matches a pre-selected temperature.

14. The system as claimed in claim 13, said first unit further comprising a timer for selecting a time period and a controller in communication with said timer for generating an alert signal when the selected time period has expired, wherein said controller is in communication with said radio frequency transmitter for wirelessly transmitting the alert signal from said radio frequency transmitter to said radio frequency receiver of said second unit.

15. The system as claimed in claim 13, wherein said second unit is at least partially insertible into the recess of said housing for deactivating said radio frequency transmitter and is removable from the recess of said housing for activating said radio frequency transmitter so as to provide for wireless communication between said first and second units.

16. The system as claimed in claim 13, wherein the recess of said first unit is bounded by an outer surface of said housing, and wherein after said second unit is fully inserted into the recess of said housing said second unit has an exposed surface that is substantially flush with the outer surface of said housing that surrounds the recess.

17. The system as claimed in claim 13, wherein said housing has a curved surface that surrounds the recess, and wherein after said second unit is fully inserted into the recess said second unit has an exposed curved surface that matches the curved surface of the housing that surrounds the recess.

18. A remote timer, thermometer and paging system comprising:

a first unit having a radio frequency transmitter and including a housing having a recess formed therein, said first unit including a timer for selecting a time period;

a temperature sensor for measuring temperature, said temperature sensor being in communication with said first unit;

a second unit having a radio frequency receiver adapted to communicate with said radio frequency transmitter of said first unit, wherein said first unit is adapted to wirelessly transmit an alert signal to said second unit when the temperature measured by said temperature sensor matches a pre-selected temperature or when the selected time period has expired, wherein said second unit is insertible into the recess for storage inside said first unit and is removable from said first unit for moving said second unit away from said first unit.

19. The system as claimed in claim 18, wherein said first unit includes a controller that deactivates said radio frequency transmitter when said second unit is at least partially inserted into the recess and activates said radio frequency transmitter when said second unit is removed from the recess so as to provide for wireless communication between said first and second units.

* * * * *